US005934475A

United States Patent [19]

Hikake et al.

[11] Patent Number: 5,934,475

[45] **Date of Patent: *Aug. 10, 1999**

[54] CONTAINER FOR ACCOMMODATING INK JET HEAD CARTRIDGE

[75] Inventors: Norio Hikake; Toshiaki Nagashima, both of Yokohama, Japan

[73] Assignee: Canon Kabushiki Kaisha, Tokyo, Japan

[ * ] Notice: This patent is subject to a terminal disclaimer.

[21] Appl. No.: 08/296,170

[22] Filed: Aug. 29, 1994

Related U.S. Application Data

[62] Continuation of application No. 08/055,252, May 3, 1993, abandoned, which is a division of application No. 07/613,764, filed as application No. PCT/JP90/00552, Apr. 27, 1990, Pat. No. 5,244,087.

[30] Foreign Application Priority Data

May 1, 1989 [JP] Japan ..... 1-109088
Sep. 28, 1989 [JP] Japan ..... 1-250732

[51] Int. Cl.[6] ..... B65D 85/86

[52] U.S. Cl. ..... 206/722; 206/461

[58] Field of Search ..... 206/461–470, 206/701, 722, 723

[56] References Cited

U.S. PATENT DOCUMENTS

| | | | |
|---|---|---|---|
| 2,952,353 | 9/1960 | Rohdin . | |
| 3,371,777 | 3/1968 | Lilly | 206/469 |
| 4,180,165 | 12/1979 | Kuchenbecker | 206/779 |
| 4,236,637 | 12/1980 | Castner, Sr. et al. | 206/470 |
| 4,319,684 | 3/1982 | Backman et al. | 206/470 |
| 4,569,442 | 2/1986 | Bushey | 206/470 |
| 4,605,007 | 8/1986 | Heraly | 206/723 |
| 4,734,717 | 3/1988 | Rayfield | 346/140 R |
| 4,807,747 | 2/1989 | Hadtke | 206/470 |
| 5,074,418 | 12/1991 | Buan et al. | 206/471 |
| 5,131,539 | 7/1992 | Karita et al. | 206/462 |
| 5,231,425 | 7/1993 | Masuda et al. . | |

FOREIGN PATENT DOCUMENTS

| | | | |
|---|---|---|---|
| 0082718 | 6/1983 | European Pat. Off. . | |
| 1485832 | 9/1977 | United Kingdom . | |
| 2210579 | 6/1989 | United Kingdom . | |
| 9013494 | 11/1990 | WIPO | 206/471 |

*Primary Examiner*—Jim Foster
*Attorney, Agent, or Firm*—Fitzpatrick, Cella, Harper & Scinto

[57] ABSTRACT

A container for receiving an ink jet head cartridge is provided with a plate-shaped member and a container main body which forms a space to accommodate an ink jet head cartridge by being coupled with the plate-shaped member. The container main body has a wall section which does not contact the ink jet head cartridge and a recess portion which projects from the wall section toward the accommodating space to contact and support the ink jet head cartridge.

17 Claims, 12 Drawing Sheets

CONTAINER FOR ACCOMMODATING INK JET HEAD CARTRIDGE

This application is a continuation of application Ser. No. 08/055,252, filed May 3, 1993, now abandoned, which is a divisional of application Ser. No. 07/613,764, filed Nov. 30, 1990, which issued on Sep. 14, 1993, as U.S. Pat. No. 5,244,087, which is a 371 of PCT/JP90/00552, filed Apr. 27, 1990.

The present invention is related to a packing container (hereinafter also called "accommodating container") suitable for packing contents (packed object) which should be protected from shock such as vibration, dropping etc., and in particular to an accommodating container for an ink jet head cartridge.

So far, as a packing method to protect contents which are easily damaged, it has been proposed to pack the objects in packing material, such as paper, cardboard, foamed sheet; molded plastics such as foamed polystyrene or polyurethane, etc. to buffer the shock.

In the case of the packing utilizing a cardboard box, local strength of cardboard itself is not necessarily sufficient and when a force is applied locally, cavity or damage is often produced at such part and the effect of such force often reaches the contents.

As far as the size of the cardboard box fits to the size of the packed contents, it presents no problem but if the packed object has indentations or its size does not fit to the size of the cardboard, the shock of vibration caused by falling of the package causes a local force which leads not only to damage of the package but also to deformation or damage of the contents.

As it is with the cardboard box, when an object is packed in a box made of paper, plastic, wood etc., if the shape of the packed object does not fit to the shape of the accommodating space, the object shifts in the box as the package is transported and such shifting sometimes causes damage of the contents.

Besides, cardboard box or paper is relatively costly.

On the other hand, a the method to pack the contents by wrapping them in shock buffering material, for example, by foamed sheet such as ETHA FOAM (Tradename, made by Asahi Dow Corp.) or a the sheet having air foams known by the tradename of AIR PACK etc. provides satisfactory results to some extent in regard to the protection of the contents. However, they make the packing process more complicated for wrapping an object with such sheet or for packing of the object with external packing material such as a box or package. In addition, it has the drawback that the expense for packing is more costly and the wrapping of object by such packing material increases the volume of the packed object and it requires the use of a larger external packing material and more space for transportation and storage.

Even when such sheet is used, the protection of performance of the packed object is not always satisfactory when the contents have complicated shapes.

For packing of the contents which are easily damaged, another method has been used wherein the foamed plastic molding with shock buffering effect is used as the shock buffering material.

For such foamed plastic, foamed urethane and foamed polystyrene are most typical, but from the viewpoint of cost, foamed styrol (styrene) is more frequently used.

Foamed styrol is easy to mold into a shape suitable for the shape of the contents and its shock buffering property is satisfactory, and therefore the protection of a packed object and fixing of it in the package can be easily done by using the casing and the protective material made of foamed polystyrene.

However, in order to obtain the sufficient buffering property of the foamed styrol molding, it is necessary to use molding with large wall thickness and this results in the increase of volume of the packing and the requirement of more space in transportation and storage.

For example, the volume of the casing made of foamed styrol molding or the packing which uses shock buffer and the protective material to fix the position of the contents usually becomes two to three times that of the packing which employs only a cardboard box.

Such a large increase of space occupied by the packing becomes a large burden in terms of occupancy of warehouse space and distribution cost.

The strength of the foamed styrol molding is not so high by itself, but it is easily torn due to the local shock and therefore it is the general practice to apply a sleeve-shaped cardboard sheet on the foamed styrol casing or pack the latter by a card-board outer packing. Consequently, the cost of packing becomes quite high.

A packing material is also available such as Blister Pack, wherein a PVC layer is provided at the joint to couple the box-shaped vacuum-molded main body made of PVC and the bottom plate made of the sheet with large wall thickness.

This packing material has the utility as an individual decorative box as well as function to protect contents. However, its functioning to protect the contents is not necessarily sufficient and therefore it is used generally for packing objects having a high strength, or not easily deformed objects for objects which, if damaged, would not be too serious cost-wise.

As aforesaid, the current situation is such that there exists no packing material which satisfies all the demands in regard to occupying space of the packing, cost of packing, etc.

Besides, when the maintenance of humidity is important in addition to the protection of the contents, more sophisticated and complicated packing technology is required and when such technology is employed, the cost of packing normally becomes even higher.

For example, there are such methods as to put the contents in a bag made of aluminum foil to keep off moisture, seal the bag and pack it further by the aforesaid method or in a strong casing made of aluminum panel together with various shock buffering material, just like the packing of an ink jet recording head.

However, in either of the above methods, the cost of members required for the packing is high and their protective function is not necessarily sufficient. In addition, they have the drawback that during transportation, when the package collides with other objects or is dropped, airtightness of the bag is apt to be lost. Besides, an aluminum box is susceptible to deformation.

The objective of the present invention is to provide a packing container which solves the aforesaid problems of the conventional packing materials, satisfies the demands as to protection of contents, occupying space of the packing, cost of packing, etc. and can maintain a satisfactory humidity environment for the contents.

A further object of the present invention is to provide the accommodating container to pack a head cartridge used for ink jet recording equipment.

The accommodating container of the ink jet head cartridge of the present invention is characterized by being provided with a plate-shaped member, a main body of the container which forms the space for accommodating ink jet head cartridge by being jointed with the plate-shaped member, a wall section which holds the main body of the container in the state not contacting with the ink jet head cartridge and a concaved section which projects from the wall section into the said accommodating space and supports the ink jet head cartridge by contact therewith.

By having the aforesaid characteristic structure, the accommodating container of the present invention (packing container) has satisfactory performance in protecting the contents and maintaining the humidity environment, occupies less additional space when used for packing and can be made with the material of low cost.

The packing container of the present invention is suitable for the packing of precision apparatus such as glass products, plastic products, ink jet recording heads etc.

Particularly, by properly selecting the shape and thickness of the packing container of the present invention, it is possible to suppress the entry of moisture into the packing container and particularly in accommodating the head cartridge of the ink jet recording equipment, it is possible to prevent solidification of ink due to drying at the delivery nozzle. Besides, the packing container will have enough strength and excellent shock absorbing effect which enables it to protect the head cartridge in the packed state with stability and prevent splashing of ink from the delivery hole due to shock. Therefore in the packing of the head cartridge, it can prevent staining of the contents of packing due to splashing of ink and solidification of the ink having splashed out of the delivery nozzle around the nozzle.

Besides, since the packing container of the present invention has a small number of parts, it may be offered at low cost and its handling is easy.

Hereafter the present invention is explained in detail with reference to the attached drawings.

Figure 11:
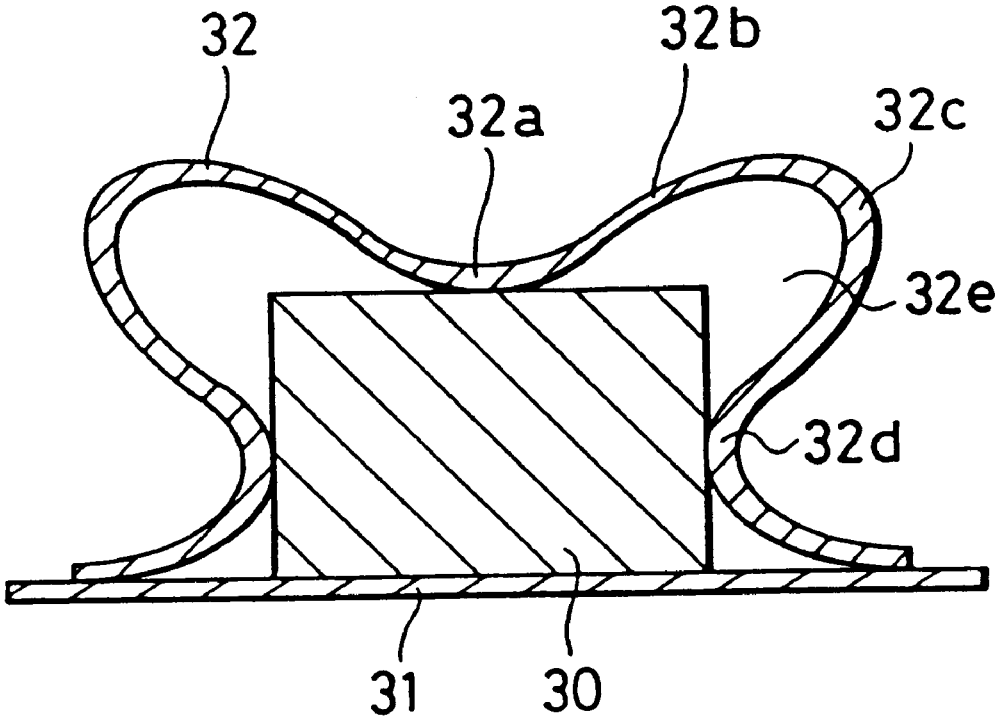
FIG. 11 is a sectional view of a model to represent the basic concept of the packing container of the present invention.

FIG. 11 is a sectional view of the model materializing the basic concept of the packing container of the present invention. In FIG. 11, a reference numeral 30 indicates the content to be accommodated in the packing container (the typical one is ink jet head cartridge). Reference numerals 31 and 32 indicate respectively the bottom plate which is a plate-shaped member and the main body of the container which accommodates the content 30 by being mutually joined in the way to hold the content 30 inside.

One of the most characteristic features of the present invention is that cavities 32*a* and 32*d* are formed in such way that they project from the main body 32 toward the inside and by such cavities, the content 30 is securely held at its position to be accommodated. By such mechanism, the content is accommodated with stability by a simple construction.

Another characteristic feature of the present invention is that the wall thickness of the container main body 32 is made larger at the point where curvature is large (at points indicated by reference numeral 32*a,* 32*c* and 32*d,* etc.) than at the point where curvature is small (points indicated by reference numeral 32*b* etc.). By so arranging, it is possible to obtain the packing container wherein the wall thickness is made larger at the points where the load of the main body 32 is more frequently applied a waste of production cost is avoided and yet necessary strength is secured.

Figure 12:
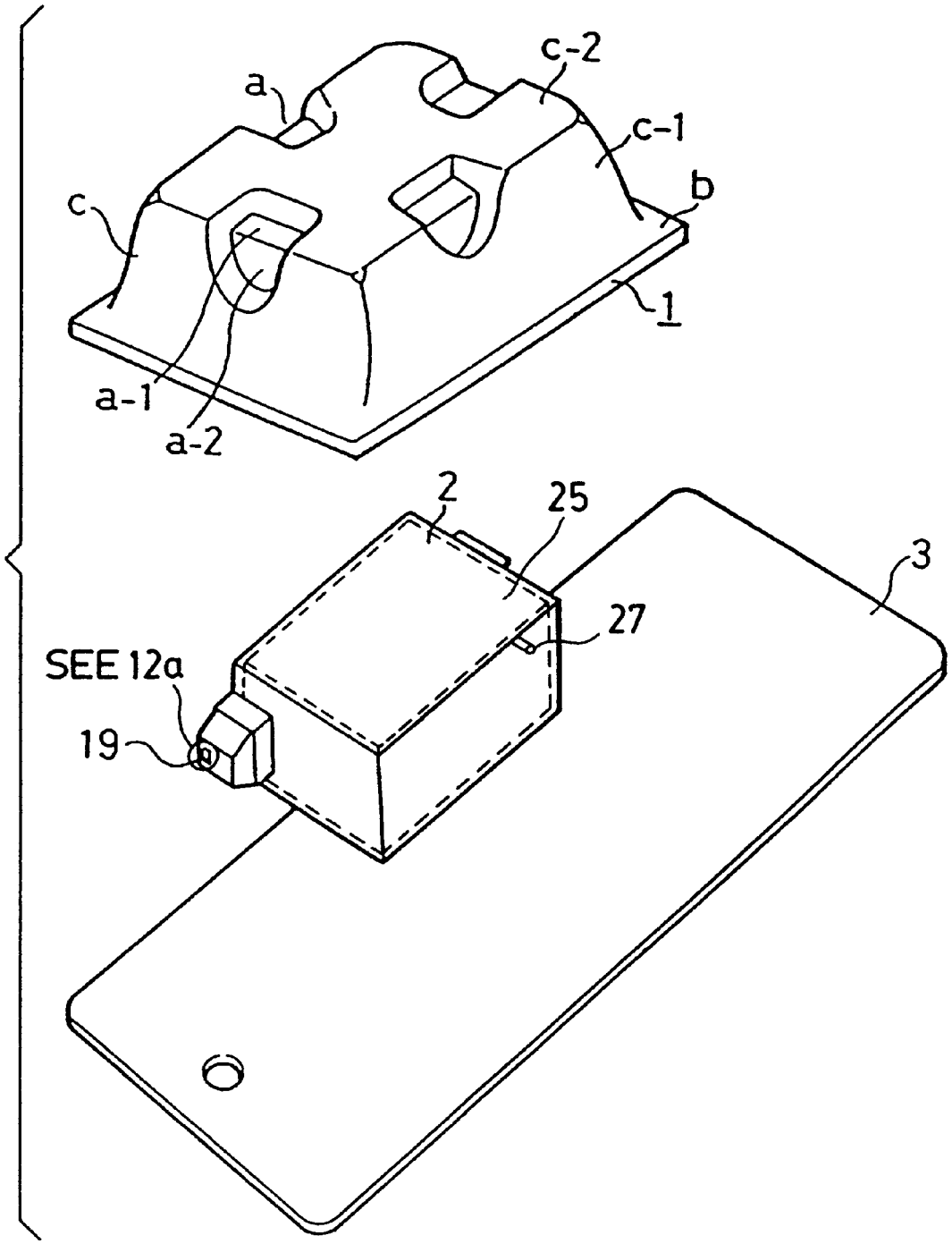
FIG. 12 is a diagonal view illustrating additional details of an ink jet head cartridge to be contained in the packing container.

Still a further characteristic feature of the present invention is that a cavity (at points 32*e* etc.) in the main body 32 other than cavities 32*a* and 32*d* is effectively utilized. By accommodating the part particularly fragile or particularly important among various parts of the content 30 (for example, the array of discharge ports 19 of ink jet head cartridge 2 as shown in FIG. 12) in such cavity, it is possible to realize secure protection of particularly important parts of the content 30 and make the packing container more compact through effective utilization of the space.

Figure 1:
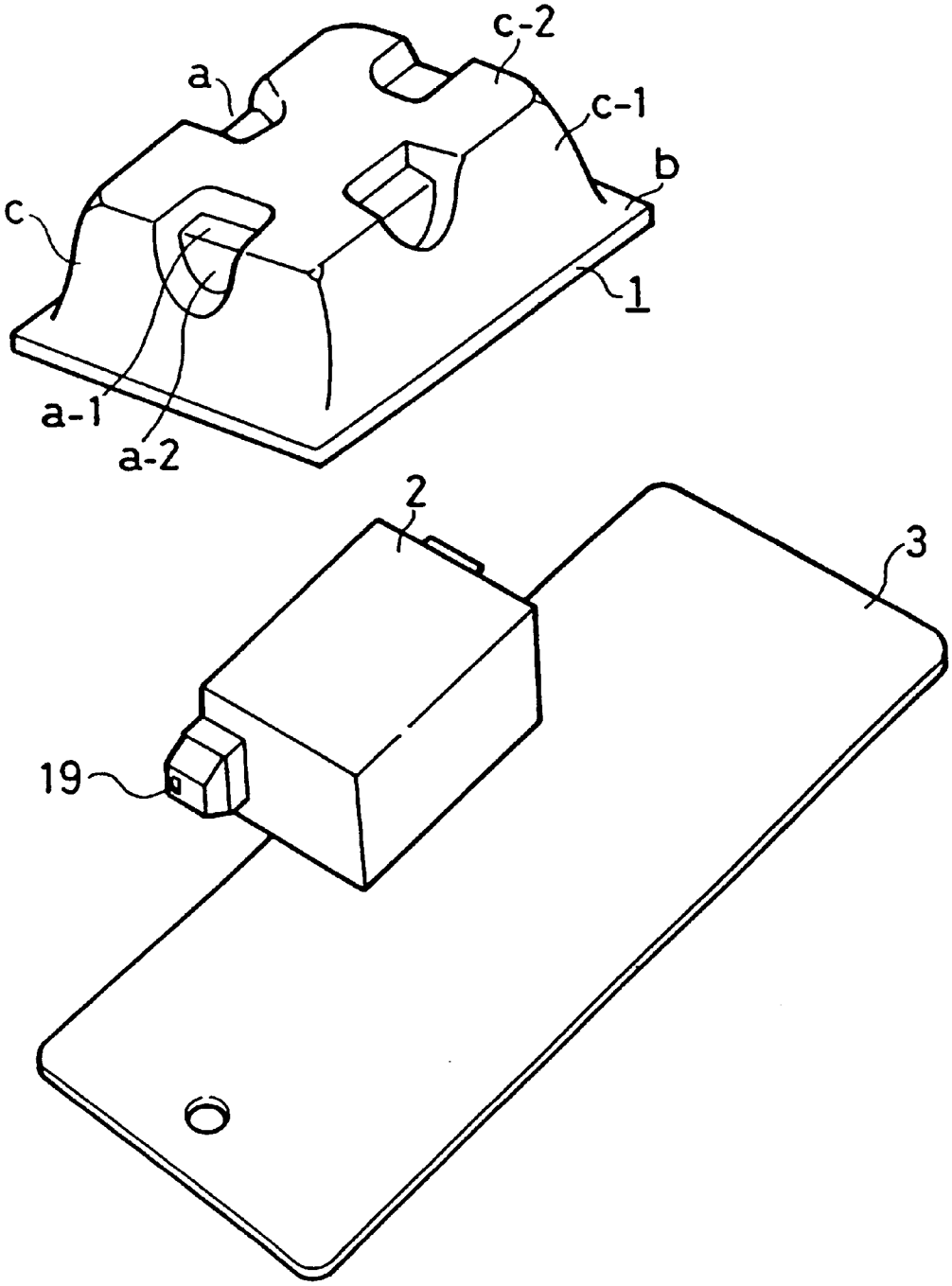
FIGS. 1 and 10 are diagonal views to indicate the state of use of an example of the packing container of the present invention.
Figure 2:
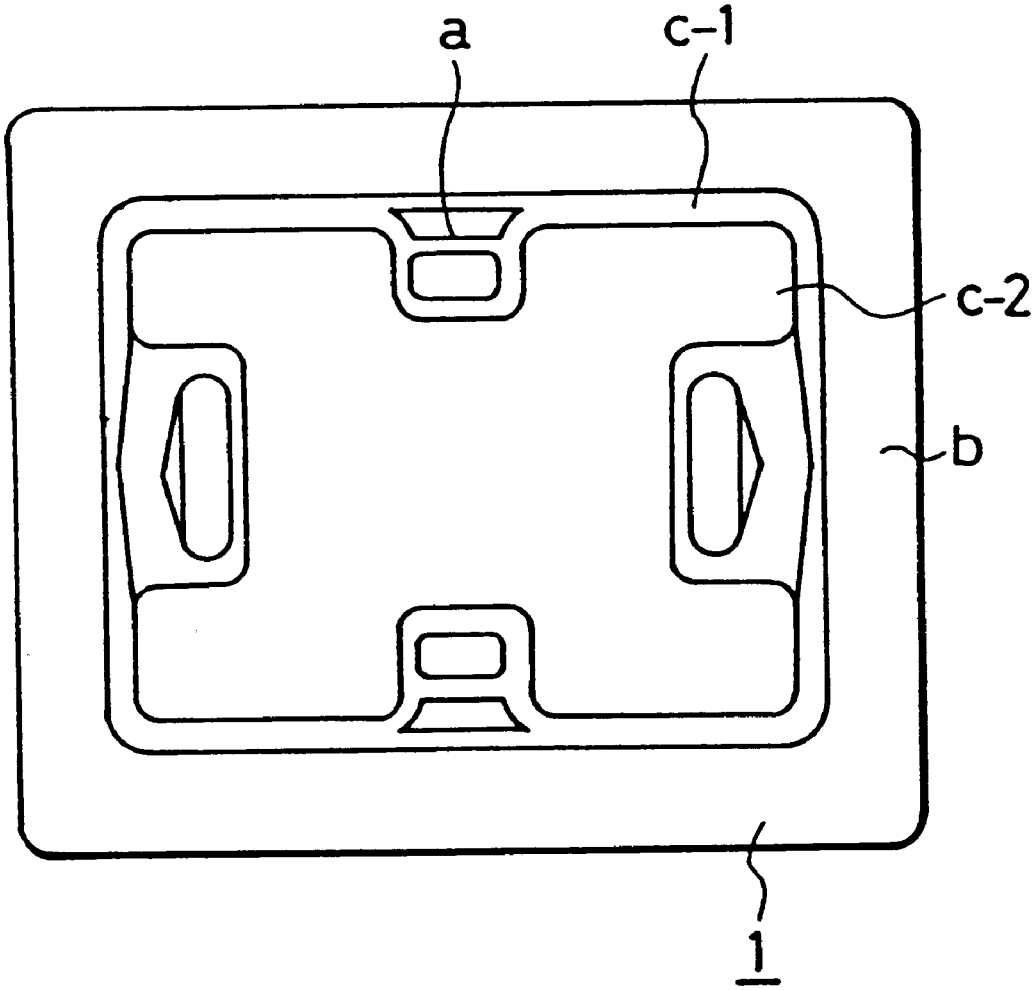
FIG. 2 is a plan view of the main body of the container.
Figure 3:
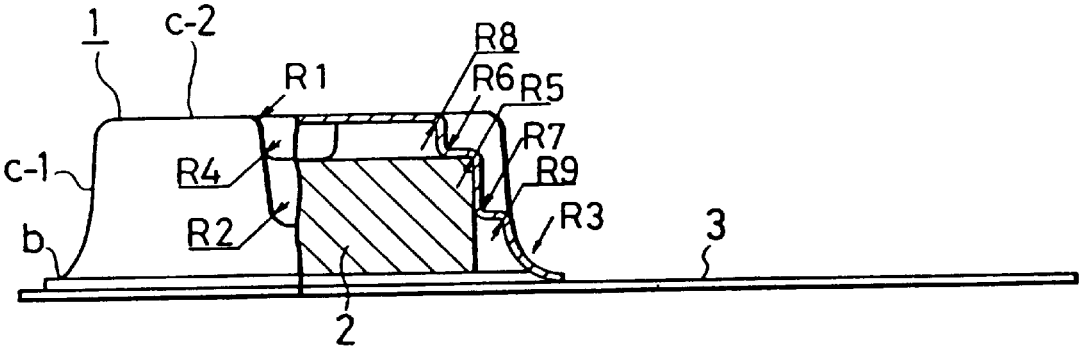
FIG. 3 is a side view to indicate a section of a part of the joined state of the main body and the bottom plate.
Figure 4:
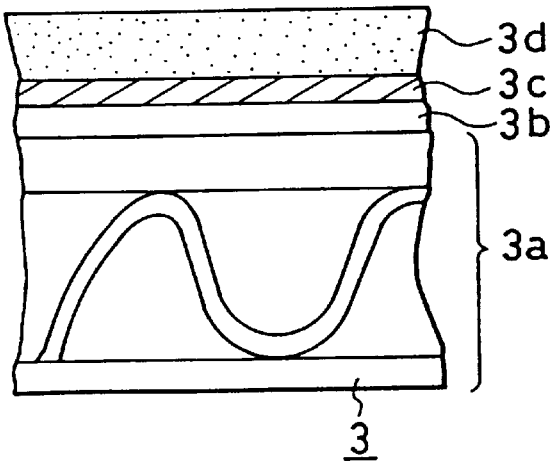
FIG. 4 is a partial sectional view of an example of a bottom plate used for the packing container of the present invention.

FIG. 1 is the developed diagonal view of the state of use of an example of packing container of the present invention; FIG. 2 is the plan view of the main body of the container and FIG. 3 is the side view to show a part of the section of the main body and bottom plate as they are joined.

This packing container is composed of container main body 1 and bottom plate 3 of the container main body and they are made into one piece to be used for packing.

The main body 1 of the container is equipped with a wall section c held in the state not contacting the content 2 (head cartridge in the drawing), a cavity projects from the wall section c toward the inside (content accommodating region d) and supports the content 2 being held there and fixes it in position and the flange b which unites such recess and the bottom plate 3 into one piece.

Wall section c must have sufficient strength and be made of the material and have the thickness which gives such strength.

The thickness of wall section c may be selected depending on the kind of constituent material and it may be for example over 0.1 mm, preferably over 0.3 mm and more preferably over 0.5 mm.

It is preferred that a recess a has the cushion effect to buffer or absorb the shock to protect the contents. In other words, if the recess a is formed in such way that it has the strength and rigidity similar to those of wall section c, the shock received by wall c is transmitted directly to the content and it may cause damage etc of the content.

From such viewpoint, it is preferred that the recess a is formed with a thin wall thickness and has elasticity. As shown in FIG. 1, the recess a includes a flat portion a-1 on the bottom portion of the container and a flat portion a-2 on the side portion of the container.

Thickness of the recess a may also be properly selected depending on the kind of constituent material, but it may be, for example, less than 0.8 mm, preferably less than 0.6 mm and more preferably less than 0.4 mm.

The constituent material of the main body 1 may be various kinds of plastics and main body 1 may be manufactured by one-shot molding using plastics, etc.

The method to use one-shot molding is preferred in view of processability, production cost, etc.

For the manufacture of main body 1 by one-shot molding, injection molding, vacuum forming etc. of various resins are available. In particular, the vacuum forming of a plastic sheet made of, for example, polystyrene, acrylonitrile-butadiene-styrene copolymer (ABS), polypropylene, polyethylene, polyethylene terephthalate etc is suitable because it facilitates adjustment of thickness of wall c and recess a and can be conducted at low cost and besides, it easily provides the desired characteristics to each section of the body.

When the one-shot molding piece is used as the main body of the container, it is preferred to use such molding of the resin as having wall thickness of preferably 0.1 mm–2.0 mm and more preferably 0.1 mm–1.0 mm.

By providing a flange b to the container main body 1, it is possible to couple the main body 1 and bottom plate 3 easily and securely.

Flanges b may be simultaneously molded with other parts at the one-shot-molding of the main body 1.

Thickness of flange b may be roughly the same with that of wall section c.

By providing curvature, upon necessity, to the rising section of the recess a, wall section c, etc., as illustrated in the drawing, it is possible to improve its shock buffering (absorbing) effect.

The radius (R1–R9 etc.) of the curvature is preferably larger within the tolerable range and it is selected properly according to the size of the recess a, but it may be more than 2 mm, preferably more than 3 mm and more preferably more than 5 mm. The shape of the cavity may be selected properly so that the protection of content 2 and fixing of its position inside the package can be made effectively.

In the example shown in the drawing, the content 2 is supported by recesses a at 4 points. As illustrated in FIG. 3, the content 2 is supported by the square section of the recess a of the container main body 1. The number of recesses may be selected properly but the style as shown in this example where such recess is provided respectively at one point of each side of the container main body in total 4 points is one of the most preferred styles.

The clearance between the content and the section of the recess a to support such content should not be too large because it may produce play or sliding of the content in the package, but neither should it be too small as it makes accommodation of the content into the main body more difficult and increases the transmission of shock from the wall section c to the content. Such clearance may be selected properly for the given construction of the recess, and proper fitting of the content and the recess but it may be 0.5 mm–3 mm or preferably about 0.5 mm–2 mm.

Figure 10:
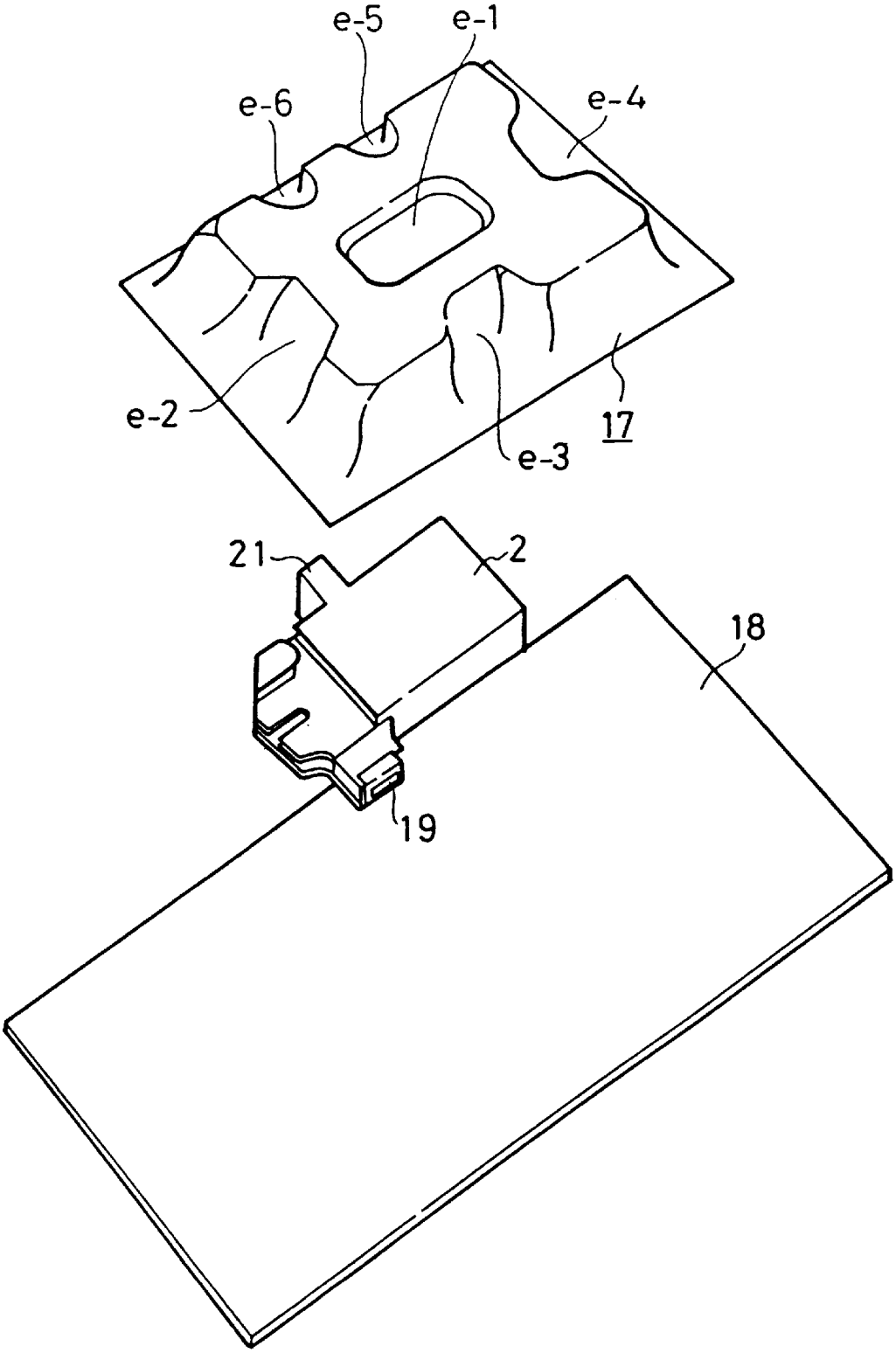

Another example of composition of the recess may be the composition having a recess at the upper center of the container main body 17 illustrated in FIG. 10.

Shape and arrangement of the recess may be selected depending on the shape, weight etc. of the content.

In FIG. 10, the ink jet head cartridge housed in the packing container has an array of discharge ports indicated by reference numeral 19 by a model as in the case of FIG. 1. Numeral 21 is a knob used in carrying the ink jet cartridge 2 and there exists an atmospheric communication hole (not shown) which communicates the inside of the ink tank provided to the ink jet head cartridge 2 with the atmosphere. As described above, the ink jet head cartridge 2 indicated in FIG. 10 is provided with the projections at two points, namely, at the discharge port section and atmospheric communication section. In order to accommodate the ink jet head cartridge 2 having such construction at low cost and with stability, recesses e-1–e-6 are provided at 6 points in total of the container main body 17 of the present example. The container main body 17 and bottom plate 18 are coupled by accommodating the ink jet head cartridge 2 at the inside. In this example also, with the container main body 17, the projection of ink head cartridge 2 is so arranged that it faces the wall other than at the recess of container main body 17 and the recesses e-1–e-6 support the content at the points other than at the projections.

Figure 12A:
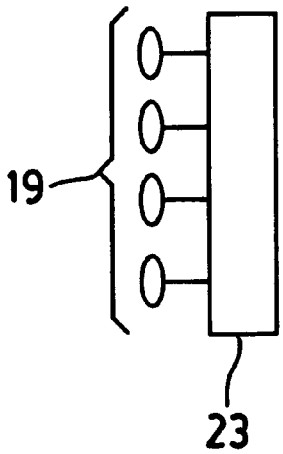
FIG. 12A is an enlarged isolated view of an electric thermo-converter for generating thermal energy to discharge ink.

In FIG. 12 the ink jet head cartridge 2 is shown with discharge ports 19 for discharging ink. FIG. 12A shows an enlarged isolated view of an electric thermo-converter 23 for generating thermal energy to discharge ink. Also shown in FIG. 12 is an ink tank 25 for storing ink and a breathing hole 27 to communicate the inside of the ink tank with the atmosphere. As will be appreciated, each of the elements shown in block or dotted outline in the figures is well know, per se, and a specific type of construction is not critical to carrying out the invention or to a disclosure of the best mode for carrying out the invention.

Figure 13:
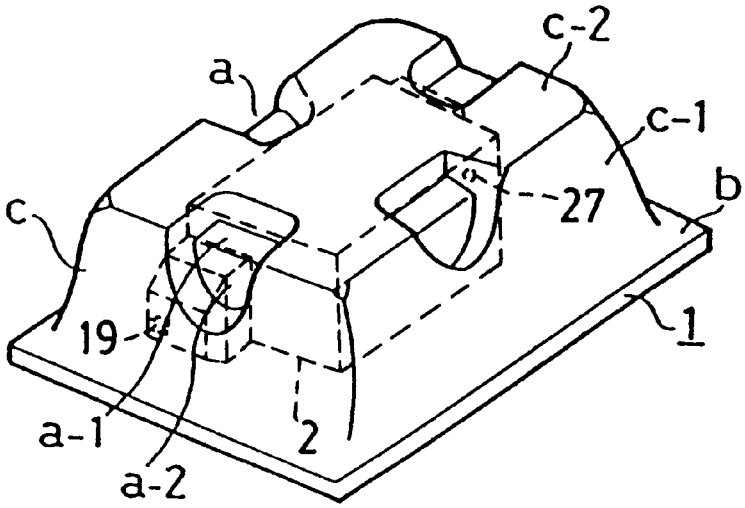
FIG. 13 is a perspective view showing the ink jet head cartridge within the packing container.

FIG. 13 shows the ink jet cartridge disposed within the container 1.

When packing the replaceable head cartridge having ink jet head section (for example of the type to record by discharging ink utilizing thermal energy) coupled with the ink tank section which stores the ink to be supplied to the ink head section, it is preferable to accommodate it in such way that the recess is arranged at the position where the array 19 of the discharge ports faces the wall section c of the container main body 1 without contacting thereto for stable protection of the array of ink discharge ports, as illustrated in FIG. 10.

Especially, when the ink jet head cartridge is housed in such way that the array 19 of discharge ports should face the side c-1 of the wall section e (faces the direction roughtly perpendicular to the bottom plate 3), the head section having the discharge ports can be better protected.

As aforesaid, by accommodating the ink jet head cartridge in such way that the array of delivery nozzles of the head faces the wall section c in the state not contacting thereto, it is possible to accommodate the array of discharge ports at the position where the discharge ports of the head are protected even when the bottom plate 3 is removed.

Therefore, the composition shown in FIGS. 1 and 10 is particularly preferable from the viewpoint of protection of the part having the array of delivery nozzles projecting from the main body of the head.

Material of construction and thickness of the bottom plate 3 may be selected according to the weight, strength etc. of the content and it may be made of plastic film, paper sheet or board, plastic panel, etc.

When emphasis is placed on the protection of the content, use of cardboard, paper with thickness of over 100 g/m$^2$ etc. are preferred as they themselves have shock buffering effect.

From the viewpoint of protection of the content, rigid plastic sheet with thickness of over 0.1 mm, preferably 0.3 mm and more preferably over 0.5 mm may be used.

When the area of the bottom of the container main body 1 is made larger, when the package drops, the probability of its dropping over the side of wall c of the main body 1 becomes larger and consequently the cushion effect of recess a is more effectively utilized. Therefore the area of the bottom of container main body 1 is preferably larger within the tolerable range. When plastic film is used for the bottom plate 3, it is possible to utilize the shock buffering property (shock absorbing property) of the bottom plate. Similar shock buffering effect may be obtained by enlarging the area of bottom plate 3 to the degree of about twice of the bottom area of the container main body 1.

Various joining methods may be utilized for coupling of container main body 1 and bottom plate 3 after accommodation of content 2 into the container main body 1.

For example, it is possible to form the container main body 1 and bottom plate 3 by the same kind of plastic material and join them by such method as thermal fusion, supersonic melt-fusion etc. It is also possible to provide an easy-to-peel layer at least at the region of bottom plate 3 which is required for joining and do such bonding by utilizing it.

The method to utilize an easy-to-peel layer enables easy removal of the bottom plate 3 from the container main body 1 when unpacking the package and therefore it has the advantage of causing no damage of the content.

For example, Blister Pack is the packing material which packs the content by melting powerfully the part made of PVD of the container main body where the content is accommodated and the mounting sheet coated with PVC layer used for bonding. With such packing, the package can be opened only by destroying the mounting sheet or by breaking the sewing seam provided beforehand. When the package is opened by destroying the mounting sheet, it often requires a strong force and besides the direction of opening of the seal is unstable and it sometimes damages the content. Besides, Blister Pack does not consider the moisture proofness.

When the maintenance of moisture preventing property of the content such as moisture-proofness and convenience of opening of the package is considered, the easy-to-peel method is preferred.

For such easy-to-peel layer, the layer made of, for example, various hot-melt resins, polyethylene-based resin, polyvinylalcohol based resin etc. may be utilized.

In order to execute bonding of the container main body 1 and bottom plate 3 easily and with certainty, for example a flange b as shown in the drawing may be provided at the bottom of the container main body 1.

On the other hand, by properly selecting the constituent material of the packing container, it is possible to provide the function to maintain certain humidity environment for the content i.e., the moisture preventing function or the function to prevent evaporation of moisture of the content to the outside.

For example, by using the material obtained by coating vinylidene chloride layer or aluminum layer on various resins having the property to prevent penetration of moisture, for example, polypropylene, as the constituent material of container main body 1, it is possible to provide the aforesaid function to maintain the humidity environment.

From the viewpoint of manufacturing cost, moldability, processability etc. polypropylene is suitable.

At the same time by using the resin film, sheet or plate or paper sheet or plate coated with vinylidene chloride layer or aluminum layer or polypropylene with moisture penetration preventing property, a favorable moisture environment maintaining function is obtained. The packing material which is preferred for both shock buffering property and humidity environment maintaining property, may be the bottom plate composed of paper sheet or cardboard lined with aluminum layer and having the layer to give tight adhesion to the container main body (for example an easy peel layer). Among such materials, cardboard provided with aluminum layer is preferred in view of cost, shock buffering property and moisture environment maintaining function.

When plastic sheet is used, the thickness of the bottom plate may be, from the viewpoint of moisture-proofness, over 0.1 mm, preferably over 0.2 mm and more preferably over 0.3 mm.

When the container main body is formed by vacuum forming using polypropylene and the recess a or rising section of wall c etc. are formed into a curved section as stated above, even better shock buffering characteristic may be given to the container main body 1 and the better moisture environment maintenance effect may also be obtained.

Further, to employ male form molding process wherein the sections other than the section forming the ceiling c-2 of the material sheet are extended in vacuum toward the bottom plate (flange b) from the ceiling c-2 of the container main body 1 to form the recess a side plane c-1 of the wall, a curved section will give better uniformity of thickness and generate no pinholes and is desirable in increasing moisture penetration preventive effect of various parts.

When male form molding is employed, the ceiling c-2 which is apt to become thin in the case of female form molding can be made thick and besides, even when the recess a should have a complicated shape, it is possible to increase the strength of a corner and thus the container main body is given preferred characteristic in regard to both moisture permeability and shock-resistance when dropped. Besides, the flange b which is flat and may be made thin in wall thickness can be made thinner than in the case of female form molding and as the result, it is possible to reduce the rigidity of the container main body 1 having the flange section b to an appropriate degree, and when the container main body 1 is joined under pressure to bottom plate 3 utilizing the jig, it is possible to bond them by fitting these surfaces more uniformly and securely.

When no curved section is provided, on the container main body obtained by vacuum forming, the border between the wall and the recess of the container main body and the border of the wall and the flange, etc. are formed into corners with thin wall thickness and thus it often produces pinhole and causes damage when the package is dropped and moisture penetration preventive characteristics of the package also deteriorate.

Whereas when such borders are formed into curved sections, formation of the section with thin wall is prevented and preferred moisture penetration preventing property is obtained uniformly for the entire part of the container main body and the peripheral parts of the package also resist the shock of being dropped.

When a transparent or semitransparent material is chosen for the container main body 1 and/or bottom plate 3, the content 2 can be observed through the wall as it is yet packed in the package.

[PREFERRED EMBODIMENT]

Embodiment 1

Using a polypropylene sheet with a thickness of 1 mm, the container main body with the construction as shown in FIG.

1 was manufactured by male form vacuum forming wherein the sections other than ceiling c-2 were elongated toward the bottom section and formed thereby.

The size of each section was as follows:

Minimum wall thickness: 0.2 mm

Radius R of curvature at curved section: 3 mm

On the other hand, E cardboard 3*a* was lined with polyethylene telephthalate layer 3*b* (thickness 12 μm), aluminum layer 3*c* (thickness 9 μm) and polyethylene-based easy peel layer 3*d* (thickness 30 μm) by this order and it was cut in rectangular shape to obtain the sectional line twice as large as that of the container main body and thus the bottom plate 3 was prepared. The area of the bottom plate 3 was about twice of the bottom plate of container main body 1.

Then an ink jet recording head 2 (200 g) charged with ink was housed in the container main body 1 and the bottom plate 3 was joined with the bottom surface of the container main body and the flange b and the bottom plate 3 were bonded by a supersonic welding machine.

The thus obtained single package was dropped from the height of 95 cm on a concrete floor for 10 times and the state of protection of the recording head was inspected. No damage etc. was observed at the recording head.

When twenty of such packages were consolidated into a collective package and similar dropping tests were conducted, no abnormality was observed on each recording head.

Further, the prepared package was left for one week at 60° C. in a dry atmosphere and the amount of evaporation of moisture from the ink charged in the recording head was checked by measuring the weight of recording head and as the result, decrease of weight of ink corresponding to the amount of evaporation of water of 0.14 g was observed.

Embodiment 2

Except for using vinylidene chloride sheet of 30 μm in thickness, the container main body was manufactured in the same way as in the case of embodiment 1, and an ink jet recording head was packed in it.

A dropping test of thus prepared package was conducted in the same way as in the case of embodiment 1 and no abnormality such as damage was observed at the packed recording head.

When the amount of moisture evaporation from the ink of the recording head was measured as in the case of embodiment 1, it was 0.17 g.

Embodiment 3

Except for setting the radius R of the curved section at 1 mm, container main body was prepared in the same way as in the case of embodiment 1 and an ink jet recording head was packed in it. A dropping test was conducted on such package and the amount of evaporation of moisture was measured.

The minimum thickness of the wall of the container main body was 0.05 mm.

As the result, in the dropping test, generation of dents and pinholes was observed at the container main body of the package but there was no abnormality on the packed recording head.

The amount of moisture evaporation from the recording head was 0.25 g.

Embodiment 4

Except for using polypropylene film of 120 μm and polypropylene sheets of 0.1 μm, 0.3 μm and 0.5 μm in thickness as bottom plate, the ink jet recording head was packed in the same way as in embodiment 1.

After dropping the thus obtained package under the same conditions as in the case of embodiment 1 with bottom plate side falling first, the state of the packed recording head was inspected.

When the sheet of 0.1 μm in thickness was used, considerable leakage of ink was observed and the ink head was difficult to use for practical purpose.

When the sheet of 0.3 μm and 0.5 μm was used, a slight amount of leakage of ink at the recording head was observed but there was no problem in the practical use of the head.

On each package, the amount of moisture evaporation from the ink in the recording head was measured in the same way as in embodiment 1.

The result is shown in Table 1.

TABLE 1

| Thickness of bottom plate (μm) | Amount of moisture evaporation (g) |
|---|---|
| 0.5 | 0.19 |
| 0.3 | 0.24 |
| 0.1 | 0.38 |

Embodiment 5

The container main body was formed by the female form molding wherein the polypropylene sheet is drawn by vacuum from the part which becomes the flange b toward various directions to form other sections (the recess a and the wall section c) and radius was set at R3=0.5 mm and the radius R of curvature of the curved section at the corner was set at 2 mm. Other than the above, the ink jet recording head was packed in the same way as in embodiment 1.

With the thus obtained package, a dropping test was conducted in the same way as in embodiment 1 and the amount of moisture evaporation from the ink was measured.

In the dropping test, no abnormality was found to the packed recording head.

The amount of moisture evaporation from the ink was 0.33 g.

Comparative Example 1

A container main body was prepared in the same way as in embodiment 1 except for providing no recesses and an ink jet recording head was packed in such container.

A dropping test was conducted on the thus prepared packing and the amount of moisture evaporation from the ink was measured.

In the dropping test, the play of the recording head in the package was excessive and by the shock of collision of the box against the floor, leakage of ink and damage of recording head occurred and the head was unusable.

Comparative Example 2

Figure 5:
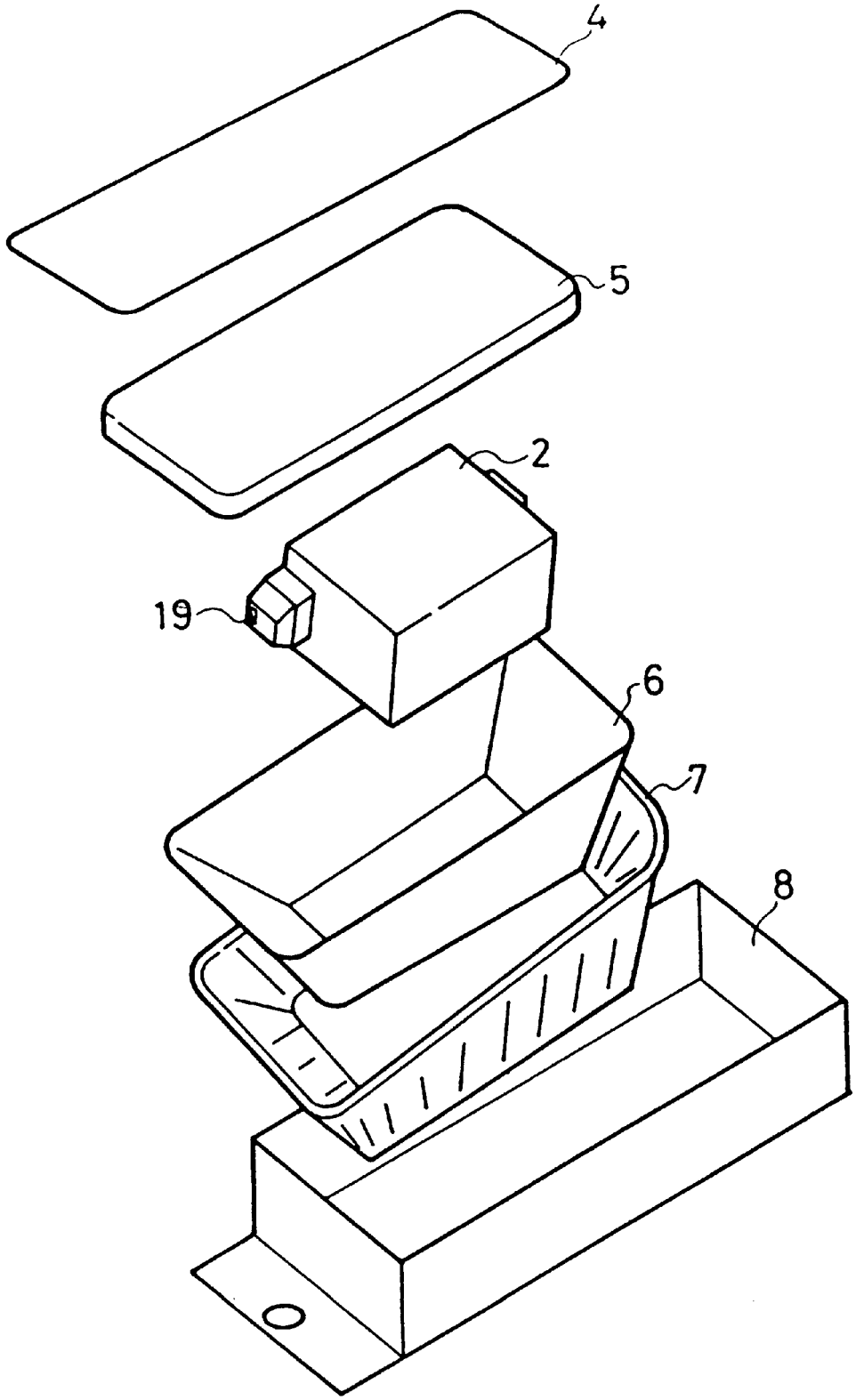
FIGS. 5, 6A, 6B, 7, 8 and 9 are the drawings to explain the conventional method of packing.

As illustrated in FIG. 5, an ink jet recording head (200 g) charged with ink was placed in a vacuum forming container 6, and the lid was applied thereon. The container was placed in an aluminum container with wall thickness of 0.1 mm and its opening was covered by a film 4 of 50 μm in thickness having an adhesive layer and it was placed in an individual box 8 and packed.

A dropping test similar to that of embodiment 1 was conducted using thus prepared package independently and the conditions of the recording head was observed. No abnormality was found.

However, in the dropping test conducted on an aluminum container which is not housed in the individual box or on collective packing of one hundred unit packages, deformation of aluminum container, generation of pinholes due to damage were observed in 1–2% of the packages. When the aluminum container was deformed or a pinhole was generated due to damage, the moisture permeation preventing effect becomes inferior.

When the cost of packing of the present comparative case was compared with the packing cost of embodiment 1, the former was about twice of the latter.

Opening of the package made by the present comparative case was complicated when compared to that of embodiment 1 and the time required for unpacking was about 3 times as long as the later.

Unpacking of the package prepared in the present comparative case was much more complicated than that of the unpacking work of the package of embodiment 1 and the time required for its unpacking was about 3 times as long as that of embodiment 1.

In the case of the package obtained in embodiment 1, it was possible to see the state inside the package but with the package prepared in the present comparative case, the state of the inside of the package could not be seen.

In the case of the packing method employed in the present comparative case, the number of parts was many, automation of packing was difficult and it was difficult to introduce the packing step of the present comparative case directly into the automatic production line producing more than two kinds of contents (recording head) having different shapes on one production line and installation of a separate packing line was necessary. According to the results of trial calculation made by the present inventors, when the packing process of the present comparative case was employed, a facility investment was about 1.5 times of that of the case when the packing method of embodiment 1 was directly incorporated in the automatic production line.

Comparative Example 3

Figure 6A:
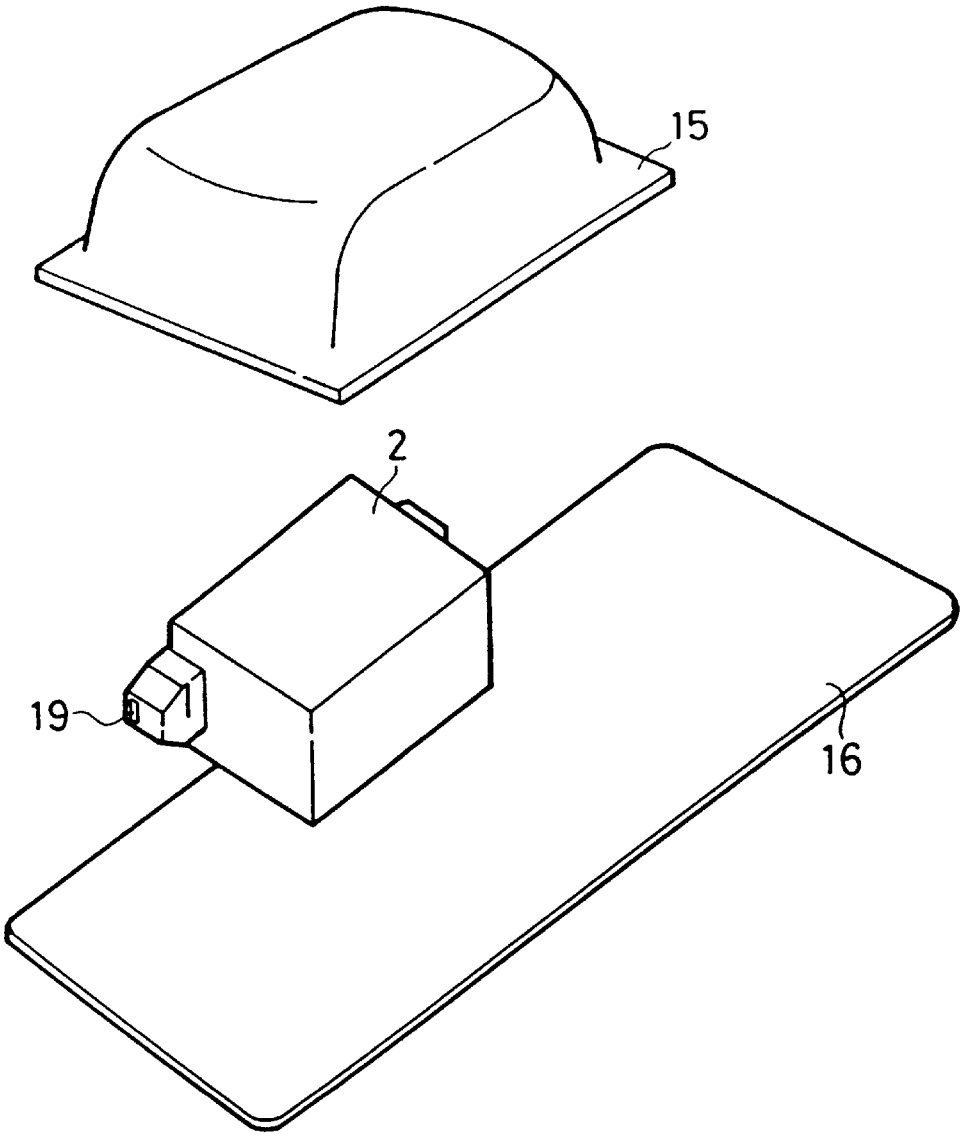
Figure 6B:
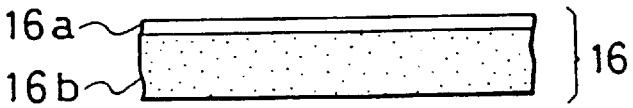

As shown in FIGS. 6A and 6B, a dropping test similar to that of the embodiment 1 was conducted on the composition of the package of the ordinary Blistapack type package and the amount of evaporation of moisture from the ink was measured.

Container main body 15 was simply matched to the shape of the recording head and for the mounting sheet (16*b*), a cardboard of 100 g/cm$^2$ on which PVC layer 16*a* was coated was used.

In the dropping test of the individual package, a large amount of ink splashed within the package due to the shock of falling and collision against the floor.

The amount of evaporation of moisture was 1.8 g.

Comparative Example 4

Figure 7:
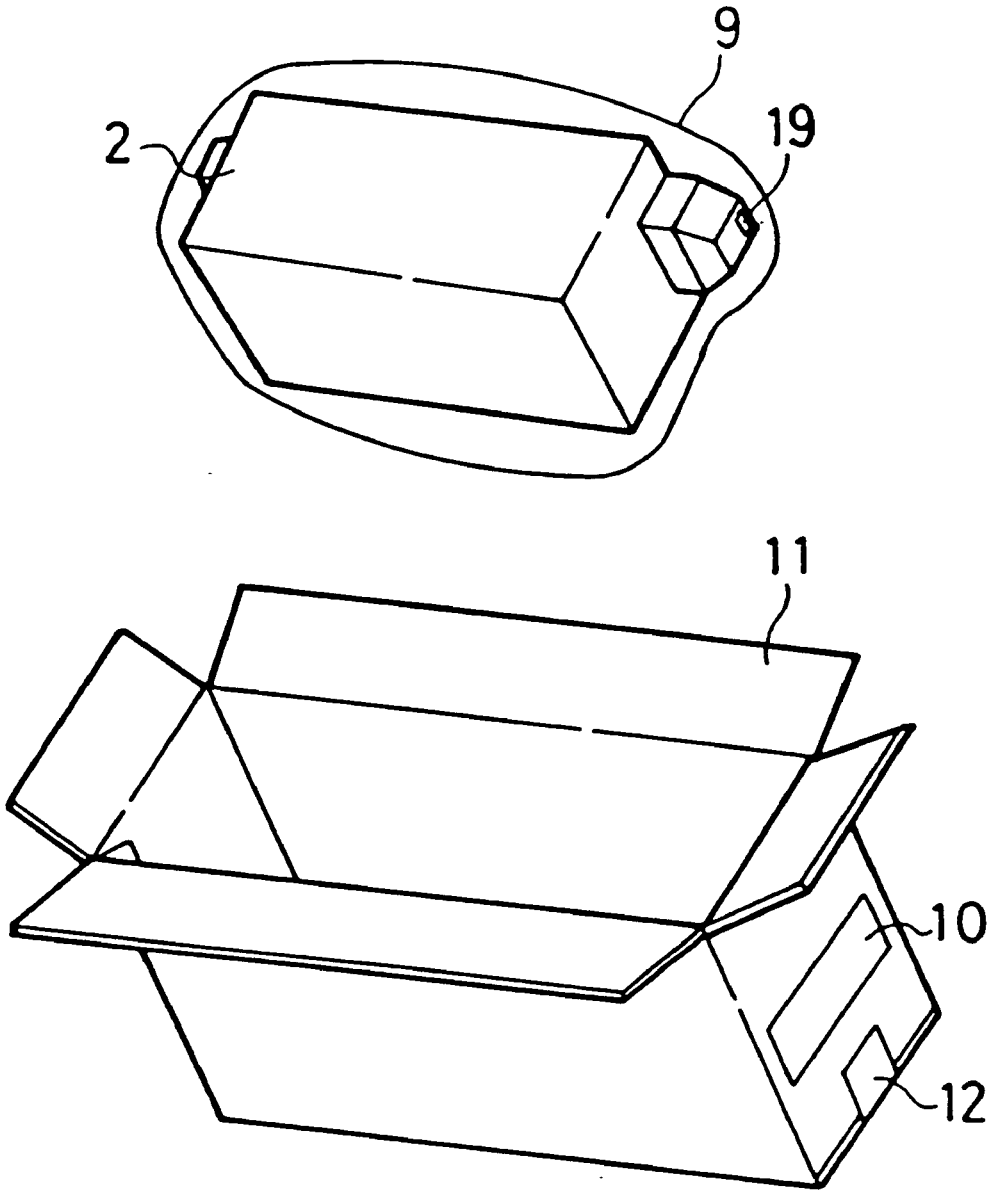

As illustrated in FIG. 7, an ink jet recording head 2 was housed in the bag 9 made of aluminum, the bag was sealed and it was accommodated in the individual packing box 11 and packed by tape 12.

A dropping test similar to embodiment 1 was conducted on the thus obtained package and the state of the package was inspected. It was found that the aluminum bag was damaged, produced pinholes, splashes of ink were excessive and the recording head was unusable.

Comparative Example 5

Figure 8:
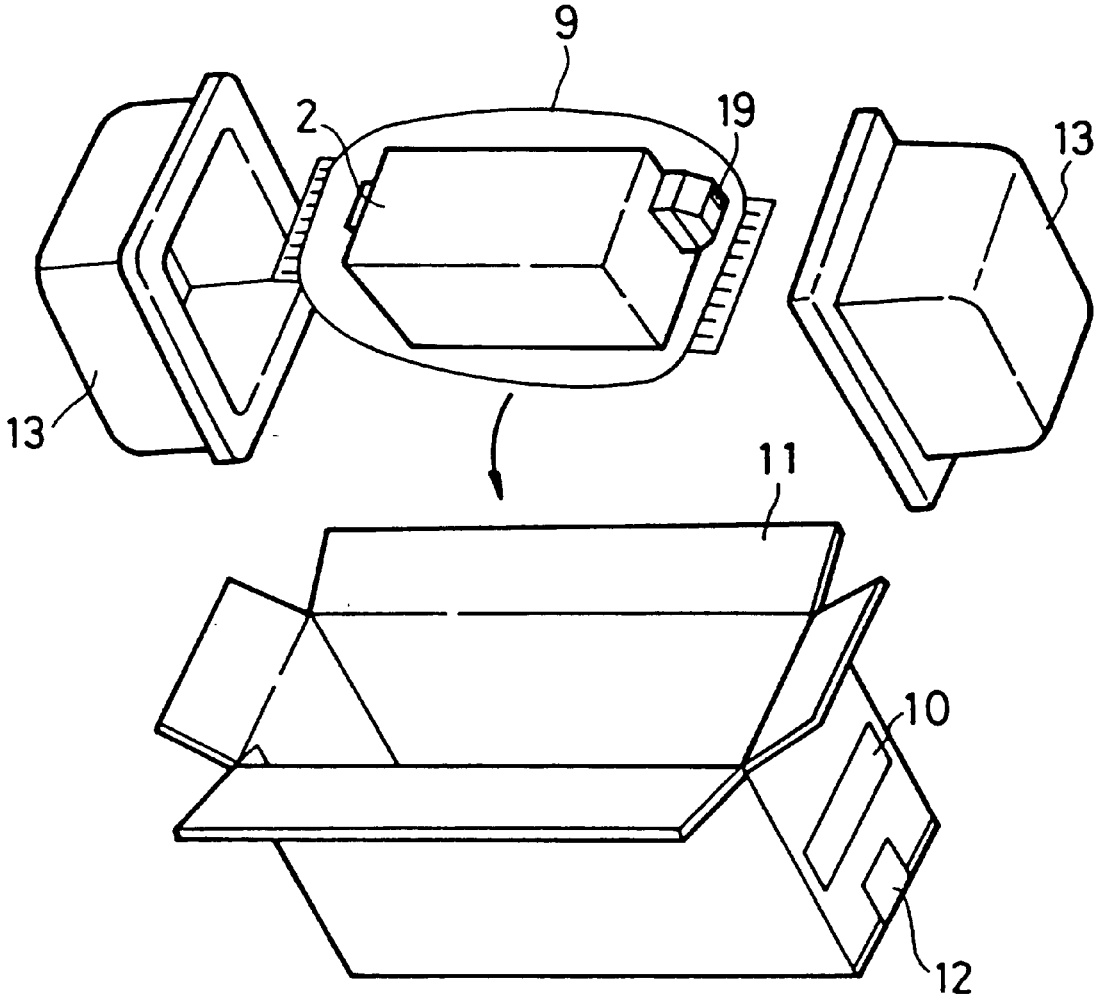

As illustrated in FIG. 8, an ink jet recording head 2 was placed in a bag 9 made of aluminum, the bag was sealed, its sides were protected by foamed polystyrene 13, and it was housed in the individual packing box 11 and packed by tape 12.

A dropping test was conducted on the thus prepared packing and the amount of evaporation of moisture from the ink was measured.

Protection of the recording head and the moisture penetration preventive effect of such packing were satisfactory.

However, the volume of the entire packing was about 3 times of that of the packing of embodiment 1 and the space occupied by the packing at transportation and storage was larger.

When the packing cost of embodiment 1 was compared to the packing cost of the present comparative case, the latter was about 3 times as much as the former.

Comparative Example 6

Figure 9:
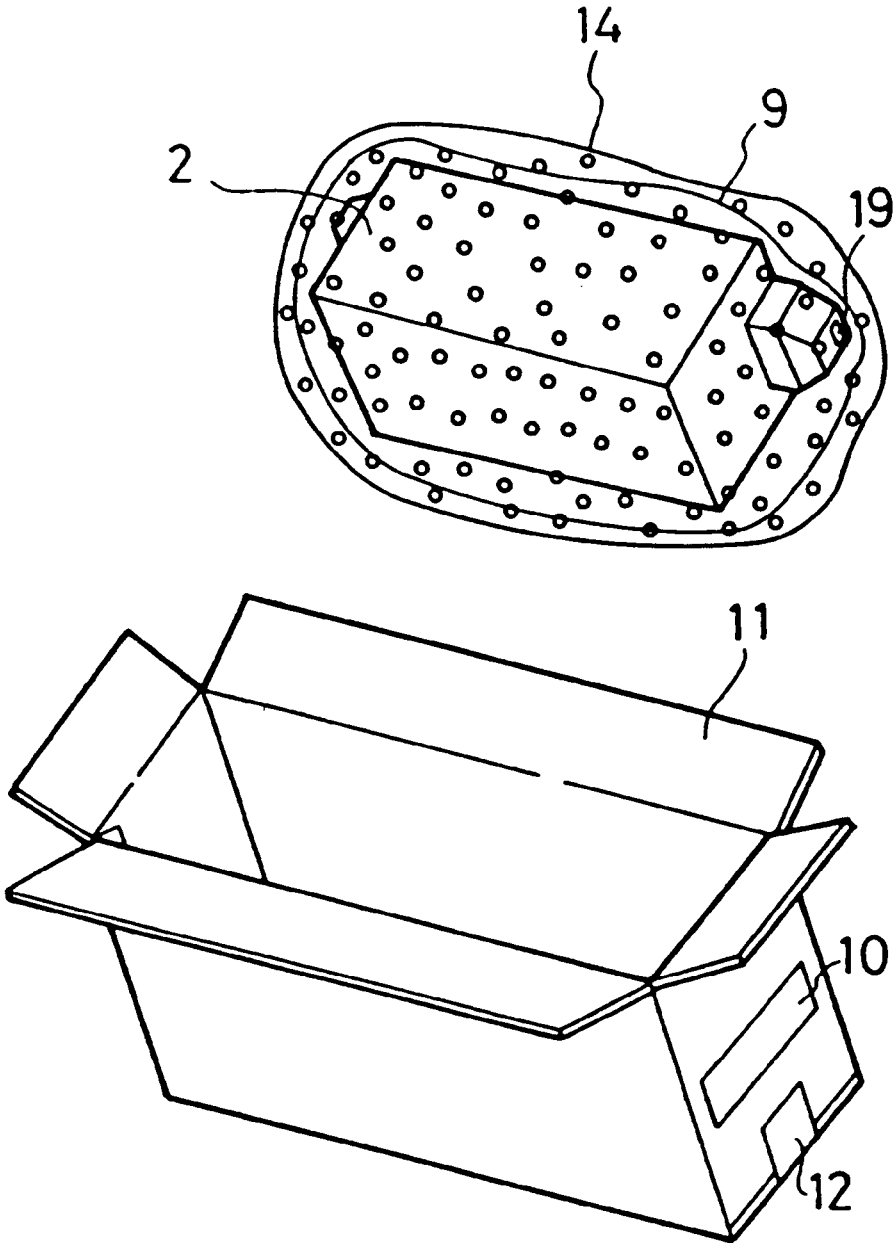

As illustrated in FIG. 9, an ink jet recording head 2 was placed in an aluminum bag 9, the bag was sealed, it was further packed in an air pack 14 and the package was housed in the individual packing box 11 and packed by tape 12.

The dropping test was conducted on the thus obtained package and the amount of evaporation of moisture from the ink was measured.

In the dropping test some leakage of ink was observed but moisture penetration preventive effect was satisfactory.

The volume of the entire package was about 1.5 times that of the package of embodiment 1 and the space occupied by the package during transportation and storage was larger.

Besides, automation of packing of the present comparative case was difficult and packing work required more manpower and the cost of packing of the present comparative case was about twice that of the embodiment 1.

By using the packing container of the present invention it is possible to protect with certainty and at low cost fragile articles such as glass product, plastic products, precision apparatus such as head cartridge for ink jet recording, electric parts etc, from vibration during transportation and the shock of dropping.

The packing container of the present invention is arranged in the way to match a shape of the content, it supports the content leaving appropriate space and it is provided with a cavity which prevents direct contact of the wall of the main body of the packing container and the content, so that the position of the content in the package is effectively fixed and the shock applied to the wall of the main body from outside is prevented from reaching the content.

In case of the packing by the packing container of the present invention, the space occupied by packing is small and therefore it is space-saving and the space occupied in the warehouse and during transportation and handling may be saved, thus reducing the cost of storage, transportation and handling.

By selecting appropriate materials of construction for the packing container of the present invention, it is possible to enable the packing container to maintain proper humidity environment for the content being packed and the packing which has excellent protective offset of the content as well as the function to maintain the humidity environment for the content is obtained.

By selecting the shape and the thickness of the packing container of the present invention, it is possible to properly suppress the moisture permeability of the container at a low level and especially for the accommodation of head cartridge for ink jet recording equipment and it is possible to prevent solidification and sticking of ink at the ink delivery nozzle due to drying. It also provides sufficient strength and shock absorbing property to the package to enable stable protection of the head cartridge in packed state and splashing of ink from the delivery nozzle due to shock is prevented. Therefore, in the packing of the head cartridge, it is possible to prevent staining due to splashing of ink in the packing container and prevent solidification and sticking of ink splashing out of the delivery nozzle at around the delivery nozzle.

As aforesaid, the present invention provides a packing container suitable for packing the content (object to be packed) which avoids the shock of vibration, dropping etc., and particularly the container is suitable for accommodating an ink head cartridge.

We claim:

1. A combination of a container and an ink jet head cartridge to be received in said container, said ink jet head cartridge being provided with a head portion having discharge ports and an ink tank to store ink to be discharged through the discharge ports, said container comprising:

a plate-shaped member; and a main body coupled to said plate-shaped member to form a space for accommodating said ink jet head cartridge, with said main body having a wall section not in contact with said ink jet head cartridge and four recess sections which project inwardly from said wall section to contact and support said ink jet head cartridge, at least one of said recess sections being located to support a first side of said ink let head cartridge on which said head portion is disposed and another of said recess sections being located to support a side of said ink jet head cartridge opposite from said first side of said ink let cartridge, wherein a clearance between said recess sections for supporting said ink jet head cartridge and said ink jet head cartridge is between 0.5 mm–3 mm, wherein each of said four recess sections includes a vertical face for contacting one of four sides of said ink jet head cartridge for restricting movement of said ink jet head cartridge in horizontal directions, and a horizontal face for contacting one of a front and a rear face of said ink jet head cartridge for restricting movement of said ink jet head cartridge in vertical directions, and wherein the discharge ports of said ink jet head cartridge are spaced apart from said wall section by said recess sections.

2. A combination of a container and an ink jet head cartridge to be received in said container, said ink jet head cartridge being provided with a head portion having discharge ports and an ink tank to store ink to be discharged through the discharge ports, said container comprising:

a plate-shaped member comprised of a combination of a material capable of maintaining a predetermined humidity condition and a material having an impact-proof property; and a main body coupled to said plate-shaped member to form a space for accommodating said ink jet head cartridge and in which the predetermined humidity condition can be maintained, with said main body having a wall section not in contact with said ink jet head cartridge and four recess sections which project inwardly from said wall section to contact and support said ink jet head cartridge, at least one of said recess sections being located to support a first side of said ink let head cartridge on which said head portion is disposed and another of said recess sections being located to support a side of said ink let head cartridge opposite from said first side of said ink let cartridge, wherein each of said four recess sections includes a vertical face for contacting one of four sides of said ink jet head cartridge for restricting movement of said ink jet head cartridge in horizontal directions, and a horizontal face for contacting one of a front and a rear face of said ink jet head cartridge for restricting movement of said ink jet head cartridge in vertical directions, and wherein the discharge ports of said ink jet head cartridge are spaced apart from said wall section by said recess sections.

3. A combination according to claim 2, wherein said ink jet head cartridge comprises a thermal energy generating element for discharging ink.

4. A combination according to claim 2, wherein the thickness of said container main body is 0.1 mm–1.0 mm.

5. A combination according to claim 2, wherein said container main body is formed by male form molding.

6. A combination according to claim 2, wherein said recess portions have thinner walls than said wall section.

7. A combination according to claim 6, wherein each recess portion has a wall thickness of less than 0.4 mm.

8. A combination according to claim 6, wherein said wall section has a wall thickness of greater than 0.5 mm.

9. A combination according to claim 2, wherein the material of said plate-shaped member having the impact-proof property comprises a resin film or plate which has a thickness of 0.1–0.5 mm, or a paper film or plate which has a weight of 100 mg/m$^2$.

10. A combination according to claim 2, wherein the material capable of maintaining a predetermined humidity condition in the space is selected from a resin film or plate, vinylidene chloride or aluminum.

11. A combination according to claim 2, wherein said plate-shaped member is comprised of polypropylene as both the material capable of maintaining a predetermined humidity condition in the space and the material having the impact-proof property.

12. A combination according to claim 2, wherein a junction surface between said main body and said plate-shaped member is provided with an easily peeled layer.

13. A combination according to claim 2, wherein said ink jet head cartridge is filled with ink.

14. A combination of a container and an ink jet head cartridge to be received in said container, said ink jet head cartridge being provided with a head portion having discharge ports and an ink tank to store ink to be discharged through the discharge ports, said container comprising:

a plate-shaped member comprised of a combination of a material capable of maintaining a predetermined humidity condition and a material having an impact-proof property; and a main body coupled to said plate-shaped member to form a space for accommodating said ink jet head cartridge, with said main body having a wall section not in contact with said ink jet head cartridge and a plurality of recess sections which project inwardly from said wall section to support said ink jet head cartridge, at least one of said recess sections being located to support a first side of said ink jet head cartridge on which said head portion is disposed and another of said recess sections being located to support a side of said ink jet head cartridge opposite from said first side of said ink jet cartridge, wherein each of said recess sections includes a vertical face for contacting a side of said ink jet head cartridge for restricting movement of said ink jet head cartridge for restricting movement of said ink jet head cartridge in horizontal directions, and a horizontal face for contacting one of a front and a rear face of said ink jet head cartridge for restricting movement of said ink jet head cartridge in vertical directions, and wherein the discharge ports of said ink jet head cartridge are spaced apart from said wall sections by said recess sections.

15. A package for receiving an ink jet cartridge having an ink jet portion and an ink tank portion, comprising:

a container body defining a space for containing the ink jet cartridge and an open plane of substantially rectangular parallelepiped shape for receiving the ink jet body; and a lid for covering the open plane of said container body, wherein said container body includes four lateral side surfaces, with at least two of said side surfaces facing each other and each of said four side surfaces having a supporting member projecting inwardly toward the space, each said supporting member having a vertical surface and horizontal surface, and wherein said vertical surface buffers the movement of the ink jet cartridge in a horizontal direction and said horizontal surface buffers the movement of the ink jet cartridge in a vertical direction so that the ink jet head portion does not contact a surface of said container body facing the ink jet head portion.

16. A package according to claim 15, wherein the ink jet cartridge is received in said container body and the open plane is covered with said lid.

17. A package according to claim 16, wherein the ink jet cartridge received in said container body contains an ink.

* * * * *

UNITED STATES PATENT AND TRADEMARK OFFICE

CERTIFICATE OF CORRECTION

PATENT NO. : 5,934,475

DATED : August 10, 1999

INVENTOR(S): NORIO HIKAKE, ET AL.

It is certified that error appears in the above-identified patent and that said Letters Patent is hereby corrected as shown below:

COLUMN 2:

Line 28, "function to protect contents." should read --functioning to protect the contents.--.
Line 29, "functioning" should read --function--.
Line 31, "or" should read --objects--.
Line 32, "objects for" should read --or for--.

COLUMN 3:

Line 4, "concaved" should read --concave--.

COLUMN 8:

Line 48, "pinhole" should read --pinholes--.

COLUMN 9:

Line 8, "telephthalate" should read --terephthalate--.

COLUMN 13:

Line 38, "let" should read --jet--.
Line 42, "let" should read --jet--.

UNITED STATES PATENT AND TRADEMARK OFFICE

CERTIFICATE OF CORRECTION

PATENT NO. : 5,934,475

DATED : August 10, 1999

INVENTOR(S): NORIO HIKAKE, ET AL.

It is certified that error appears in the above-identified patent and that said Letters Patent is hereby corrected as shown below:

COLUMN 14:

Line 5, "let" should read --jet--.
Line 8, "let" should read --jet--.
Line 9, "let" should read --jet--.

COLUMN 15:

Line 7, "for restricting movement of" should be deleted.
Line 8, "said ink jet head cartridge" should be deleted.

Signed and Sealed this

Twenty-ninth Day of August, 2000

*Attest:*

Q. TODD DICKINSON

*Attesting Officer*

*Director of Patents and Trademarks*